US007441868B2

(12) United States Patent
Seto

(10) Patent No.: US 7,441,868 B2
(45) Date of Patent: Oct. 28, 2008

(54) NOZZLE PLATE AND METHOD OF MANUFACTURING THE SAME

(75) Inventor: Shinji Seto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 367 days.

(21) Appl. No.: 11/075,230

(22) Filed: Mar. 8, 2005

(65) Prior Publication Data

US 2006/0061621 A1 Mar. 23, 2006

(30) Foreign Application Priority Data

Sep. 22, 2004 (JP) ..... 2004-276197

(51) Int. Cl.
*B41J 2/135* (2006.01)
*B41J 2/14* (2006.01)
*B41J 2/16* (2006.01)

(52) U.S. Cl. ..... 347/45; 347/47

(58) Field of Classification Search ..... 347/45
See application file for complete search history.

(56) References Cited

U.S. PATENT DOCUMENTS 5,653,901 A * 8/1997 Yoshimura ..... 219/121.71
6,290,331 B1 * 9/2001 Agarwal et al. ..... 347/47
6,752,487 B1 * 6/2004 Kubota et al. ..... 347/45
7,169,537 B2 * 1/2007 Miura et al. ..... 430/320

FOREIGN PATENT DOCUMENTS

| | | |
|---|---|---|
| JP | 48-37030 | 5/1973 |
| JP | 2000-280481 | 10/2000 |
| JP | 2001-30496 | 2/2001 |
| JP | 2001-260362 | 9/2001 |
| JP | 2001-310471 | 11/2001 |
| JP | 2003-154663 | 5/2003 |

* cited by examiner

*Primary Examiner*—Matthew Luu
*Assistant Examiner*—Lisa M Solomon
(74) *Attorney, Agent, or Firm*—Fildes & Outland, P.C.

(57) ABSTRACT

A nozzle plate in which plural nozzles that eject ink droplets onto a recording medium are formed includes: a base plate that forms a nozzle plate main body; a water-repellent plate laminated on a surface of the base plate and having water repellency; and the nozzles formed by at least one of through holes formed in the base plate and the water-repellent plate and having continuous surfaces of joint portions of the base plate and the water-repellent plate in those through holes, and a thickness of the water-repellent plate is approximately 4 to 30 μm.

1 Claim, 10 Drawing Sheets

PROVIDE WATER-REPELLENT PLATE MATERIAL

FORM WATER-REPELLENT PLATE (BORING)

FORM NOZZLE (AEROSOL DEPOSITION METHOD)

COMPLETED

PROVIDE BASE PLATE MATERIAL

FORM NOZZLE MEMBER (BORING)

FORM WATER-REPELLENT LAYER (AEROSOL DEPOSITION METHOD)

COMPLETED

NOZZLE PLATE AND METHOD OF MANUFACTURING THE SAME

BACKGROUND OF THE INVENTION (1) Field of the Invention

The present invention relates to a nozzle plate as a member for forming an inkjet recording head that ejects ink droplets onto a recording medium and a method of manufacturing the same.

(2) Description of the Related Art

In an inkjet recording head that ejects ink droplets onto a recording medium to record an image, in order to improve ink ejection stability, as shown in FIGS. 10A and 10B, water repellent finishing (a water-repellent film 104) is provided on a surface of a nozzle plate 100 on which a nozzle 102 is formed. This water-repellent film 104 has the effect of stably returning ink overflowing on the nozzle surface into the nozzle (the state in FIG. 10A).

However, as shown in FIGS. 10A and 10B, in the conventional nozzle plate 100 on which the water-repellent film 104 can not be formed thicker, at the time of ink refilling after ink ejection, because the meniscus protruded from the nozzle surface due to the overshoot of meniscus expands outside the nozzle surface and extends in a lateral direction as shown in FIG. 10B, the curvature of the meniscus surface becomes larger and the surface tension of the meniscus M becomes smaller. Accordingly, the recovery time of the meniscus becomes longer, which causes a problem in the case of high-speed driving. In FIG. 10B, the recovery force of the meniscus generated by the surface tension of the meniscus is shown by the size of the arrow F2.

Further, as another problem of the water-repellent film, it is known that, when conditions (film thickness, form, or the like) of the water-repellent film are partially different on the nozzle surface, ejection directionality of the ink becomes deteriorated at the time of ink ejection. On this account, a method of uniformly and stably forming a water-repellent film on the nozzle surface (circumference of the hole) has been proposed and implemented (e.g., see JP-A-2000-280481).

However, in view of long-term reliability, because the nozzle plate surface in the inkjet recording head is a part brought into contact with an external part, there has been a problem that, at the time of maintenance of the nozzle (especially in wiping), paper jam, or the like, a scratch or chip is produced in the water-repellent film on the nozzle surface, and thereby, the defective ejection directionality of the ink is caused and predetermined image quality can not be maintained.

Further, as a measure against the problem, a form in which a counterbore larger than the nozzle diameter is provided on the nozzle surface so that a wiping blade or the like may not be in direct contact with the surface is adopted (see FIGS. 10A and 10B). However, the problem remains because the damage to the nozzle surface due to contact with the paper at the time of jam or being wiped in a state in which the paper dust is attached to the surface can not be largely improved by the method of providing a counterbore.

Further, in order to address the problem, as shown in FIG. 11, a method of entering the water repellent finishing into the nozzle interior (a water-repellent film entrance part 106) for prevention of overflow of the meniscus M and stabilization of ink ejection has been further proposed (e.g., see JP-A-2003-154663, JP-A-2001-30496, JP-A-2001-310471, and JP-A-48-37030). However, it is very difficult to control the entrance amount of the water-repellent film (=entrance amount of ink), and, if the entrance amount can not be made constant, the ejection directionality varies, which leads a large problem.

On the other hand, a technology for stabilizing the behavior of ink within the nozzle and improving ejection performance of ink by removing the water-repellent film entered into the nozzle in the process of forming the water-repellent film on the nozzle plate surface and treating nozzle interior to have a hydrophilic property (e.g., see JP-A-2001-260362). However, even in the case of this technology, there is a problem that the high-speed driving is hindered by the above described overshoot of meniscus.

Further, in the technology of JP-A-2000-280481, the water-repellent film is formed by the spin coating method or the like, and, in this case, it is necessary to suppress the upper limit of the film thickness to about 1 μm in order to obtain a well-formed uniform thin film. Therefore, it is technically difficult to form a thick water-repellent film in a good form.

SUMMARY OF THE INVENTION

The present invention has been made in view of the above circumstances and provides a nozzle plate capable of high-speed ejection of ink droplets and preventing image quality deterioration by stabilizing ejection directionality. Further, the invention provides a method of manufacturing the nozzle plate with high quality.

According to an aspect of the invention, a nozzle plate in which plural nozzles that eject ink droplets onto a recording medium are formed includes: a base plate that forms a nozzle plate main body; a water-repellent plate laminated on a surface of the base plate and having water repellency; and the nozzles formed by at least one of through holes formed in the base plate and the water-repellent plate and having continuous surfaces of joint portions of the base plate and the water-repellent plate in those through holes, wherein a thickness of the water-repellent plate is approximately 4 to 30 μm.

BRIEF DESCRIPTION OF THE DRAWINGS

Embodiments of the invention will be described in detail based on the following figures, wherein.

DETAILED DESCRIPTION OF THE INVENTION

Figure 1:
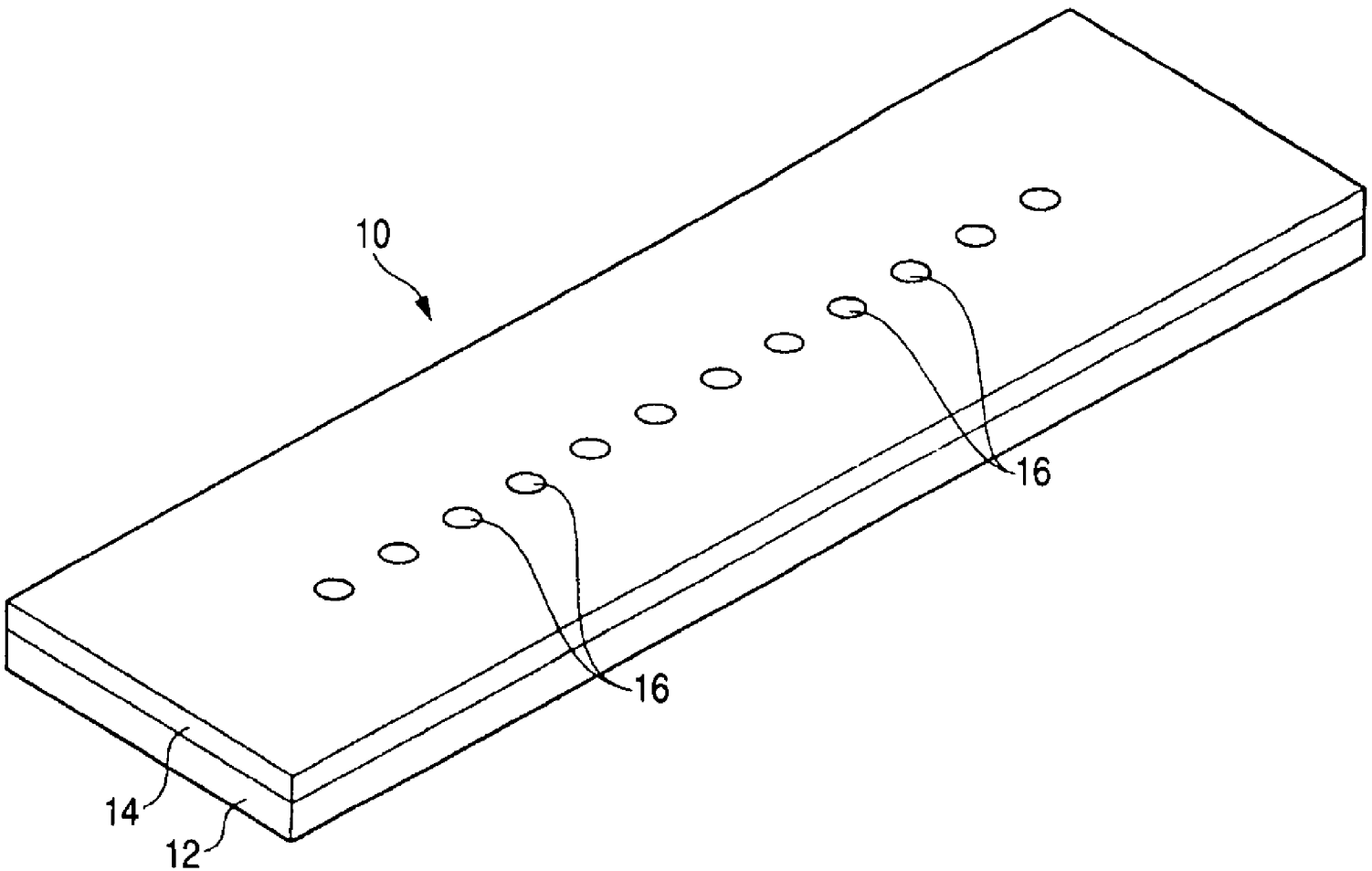
FIG. 1 is a perspective view showing a nozzle plate of an inkjet recording head according to a first embodiment of the invention.

Hereinafter, an inkjet recording head and an inkjet recording device according to embodiments of the invention will be described by referring to the drawings.

First Embodiment

First, an outline of an inkjet recording device 100 in which an inkjet recording head 102 is mounted as a first embodiment of the invention will be described, and subsequently, the main part of the inkjet recording head 102 according to the invention will be described.

Figure 7:
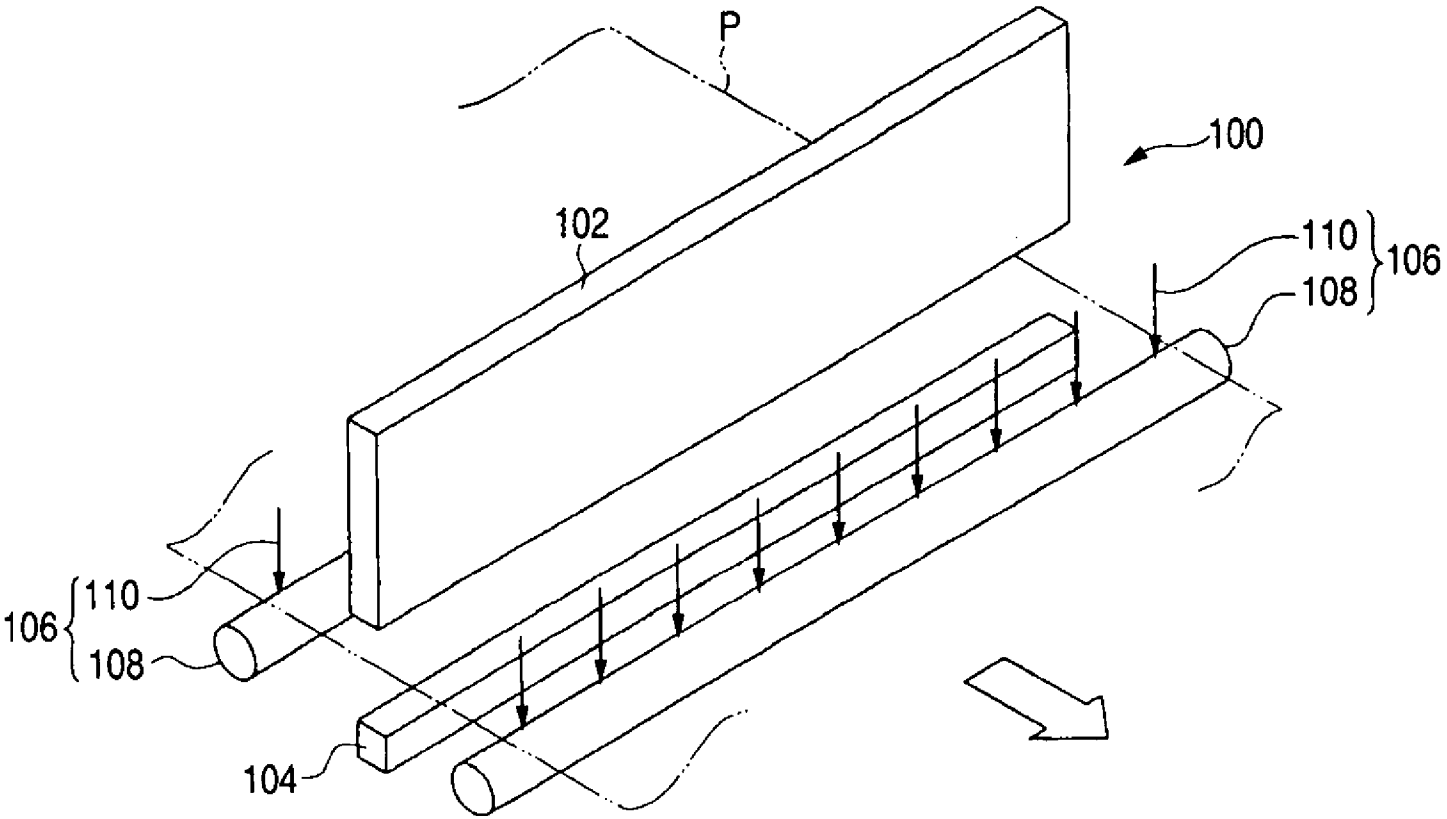
FIG. 7 schematically shows the structure of an inkjet recording device to which the inkjet recording head according to the first embodiment of the invention is applied.

As shown in FIG. 7, the inkjet recording device 100 basically includes the inkjet recording head 102 that ejects ink droplets directly onto a recording medium P such as paper in a contactless manner, a maintenance unit 104 oppositely disposed to a nozzle plate 10 (see FIG. 1) of the inkjet recording head 102, and a carrying unit 106 that carries the recording medium P in a direction of an arrow between the inkjet recording head 102 and the maintenance unit 104.

The inkjet recording head 102 may adopt any of the thermal inkjet system, piezoelectric inkjet, continuous-flow-type inkjet, electrostatic attraction type inkjet, etc. that directly eject ink droplets onto the recording medium P in a contactless manner.

Figure 8:
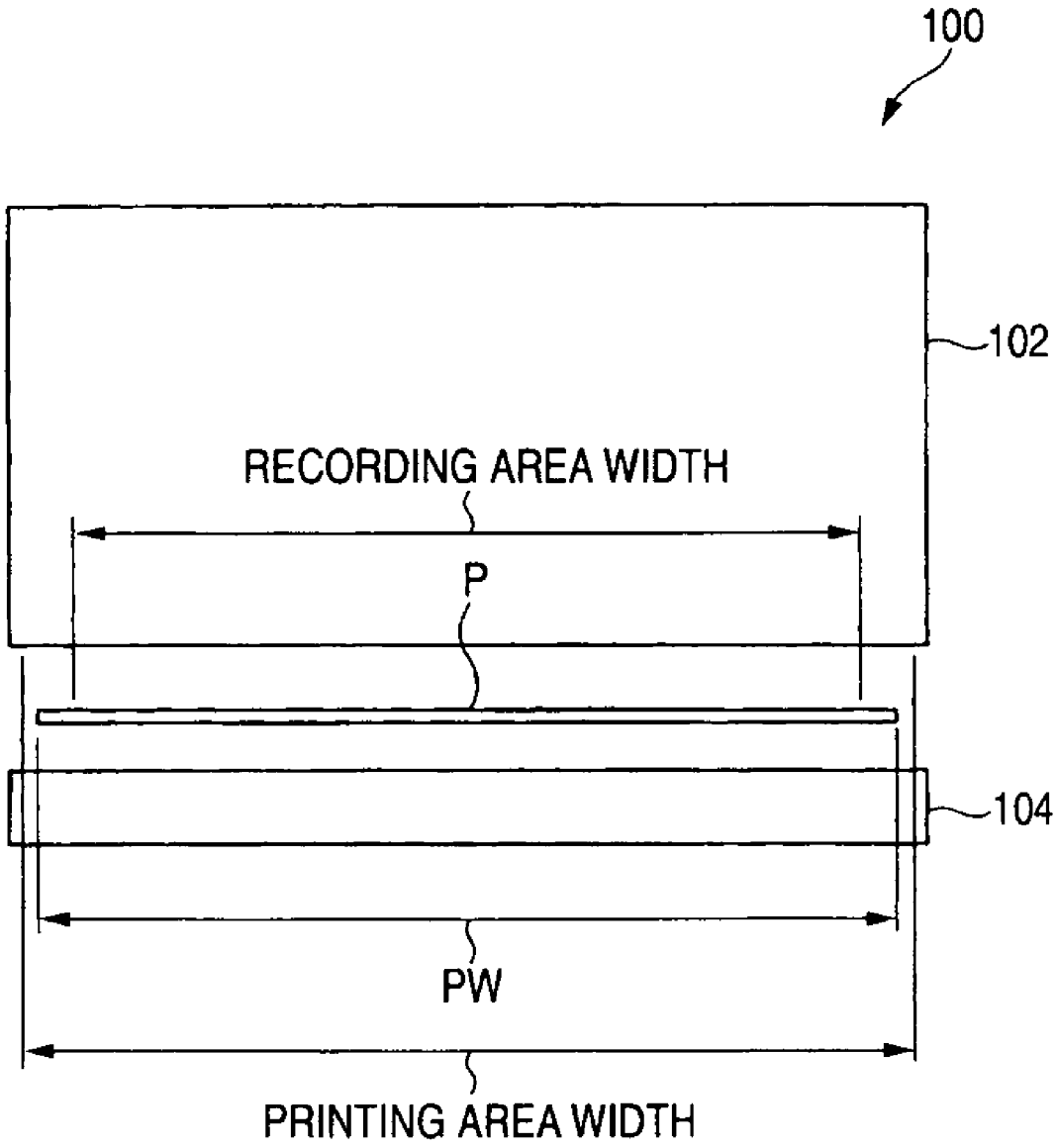
FIG. 8 illustrates a printing area of the inkjet recording device shown in FIG. 7.

Further, as shown in FIG. 8, the inkjet recording head 102 has a printing area corresponding to the maximum width PW of the recording medium P, and can perform printing over the full width of the recording medium P without scanning the inkjet recording head 102. That is, printing is completed when the recording medium P passes under the inkjet recording head 102 once.

Figure 9:
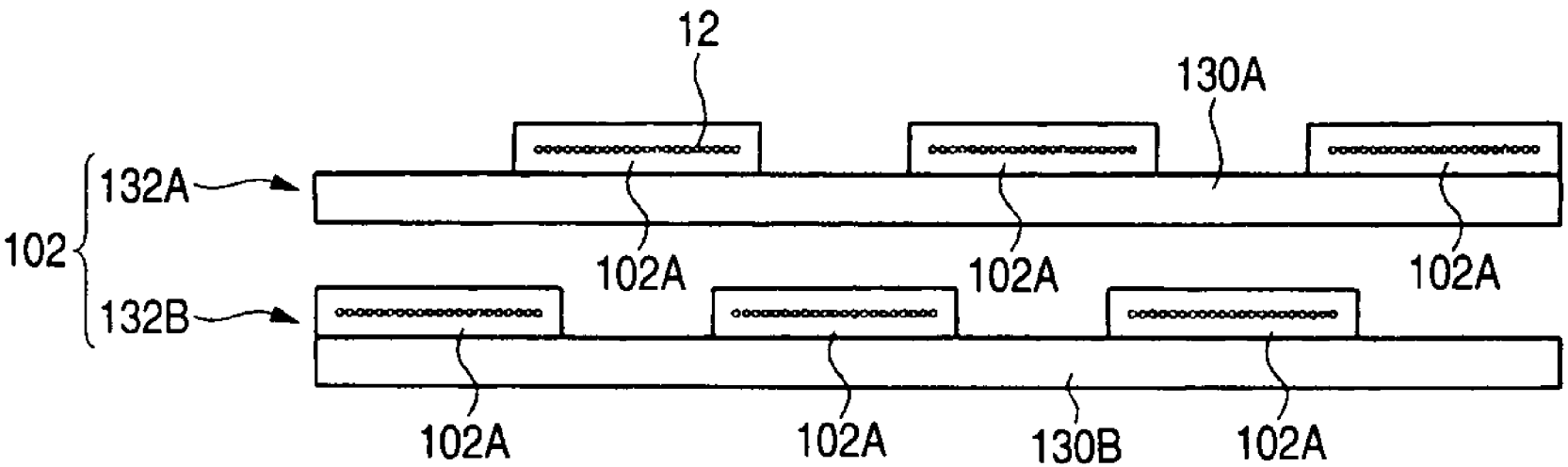
FIG. 9 schematically shows the structure of the inkjet recording head applied to the inkjet recording device shown in FIG. 7.

Further, although the inkjet recording head 102 may be formed by a monolithic long head (head chip) in which nozzles are formed in a line over the printing area, it may be formed by a combination of short heads (unit recording heads). The unit recording head (short head) 102A (see FIG. 9) can be manufactured in a larger number and the yield of the independent short heads can be improved dramatically easily compared to that of the monolithic long head. Therefore, the inkjet recording head 102 can be manufactured at lower cost by combining the unit recording heads 102A. In the embodiment, as shown in FIG. 9, the unit recording heads 102A having nozzle plates 10 (see FIG. 1) in which nozzles 16 are arranged in a line are mounted on common boards 130A and 130B with the nozzle lines leveled, and the plates are positioned so that the nozzle lines may be displaced with respect to one another. Thereby, the inkjet recording head 102 capable of continuously printing within the printing area can be formed. In this case, commonality with mass-produced inexpensive devices (recording heads) can be achieved, and the inkjet recording head 102 capable of full-width printing can be formed at low price. Further, by mounting recording head arrays 132A and 132B on the common boards 130A and 130B, respectively, the forms of the respective recording head arrays 132A and 132B are also simplified, and the manufacture and high-accuracy adjustment become easier.

Further, as shown in FIG. 7, the carrying unit 106 is disposed in a position different from that of the inkjet recording head 102 in the carrying direction of the recording medium P. This is for providing the maintenance unit 104 in a position opposed to the inkjet recording head 102. The carrying unit 106 includes a carrier roller 108 that contacts the rear surface of the recording medium P to provide a driving force to the recording medium P, and an urging part 110 that presses the recording medium P against the carrier roller 108. As the urging part 110, a method of making an urging member into direct contact with the recording medium P for urging or a method of using no member in direct contact with the recording medium P maybe applied. As an example of the latter, for example, blowing air or the like can be applied and that is superior in the point where the urging part 110 does not contact the printed recording medium P.

FIG. 1 shows the nozzle plate 10 that forms the unit recording head 102A of the above described inkjet recording head 102.

As shown in FIG. 1, the nozzle plate 10 of the embodiment includes a base plate 12 that forms a nozzle plate main body and a water-repellent plate 14 laminated on the surface of the base plate 12 and having water repellency. Further, in the nozzle plate 10, plural nozzles 16 that eject ink droplets are formed so as to penetrate the base plate 12 and the water-repellent plate 14 and these nozzles 16 are arranged in a single line.

Figure 2:
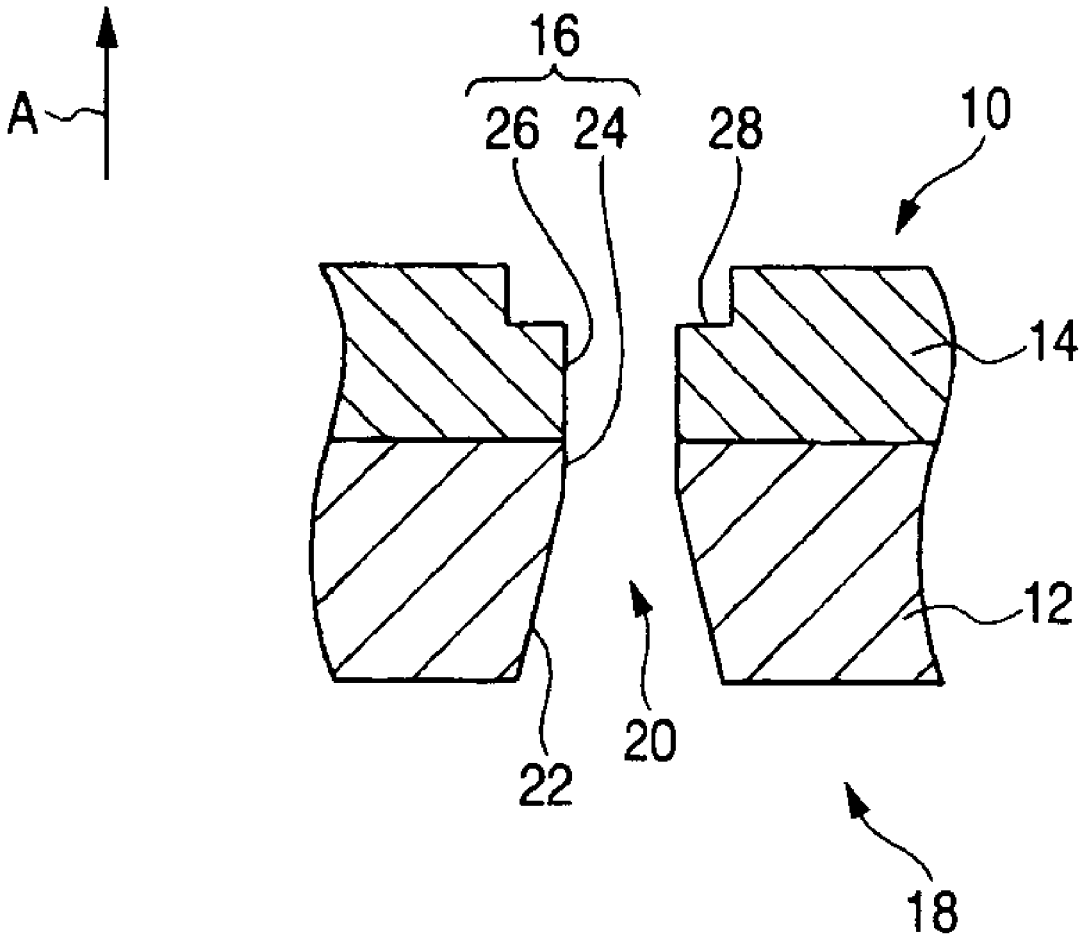
FIG. 2 is an enlarged longitudinal sectional view showing a nozzle part of the nozzle plate in FIG. 1.

In FIG. 2, a through hole part that forms the nozzle 16 of the above described nozzle plate 10 is shown.

As shown in FIG. 2, a through hole 20 that forms the nozzle 16 of the embodiment includes a tapered portion 22 formed at an ink chamber 18 side (lower side in FIG. 2) of the base plate 12 and having an opening diameter gradually becoming smaller toward the ink ejection direction (direction of the arrow A), a straight form portion 24 formed at the surface side (upper side in FIG. 2) of the base plate 12 and having an opening diameter constant toward the ink ejection direction, and a straight form portion 26 formed on the water-repellent plate 14 having an opening diameter constant toward the ink ejection direction in the same diameter as that of the straight form portion 24.

As illustrated, the joint portion of the straight form portion 24 at the base plate 12 side and the straight form portion 26 at the water-repellent plate 14 side is a continuous surface with no step, and the nozzle 16 of the embodiment is formed by these two straight form portions 24 and 26.

Further, on the surface of the water-repellent plate 14 that forms the surface of the nozzle plate 10, a counterbore portion 28 having a larger diameter than the nozzle diameter is coaxially formed at the part corresponding to the nozzle 16.

This nozzle plate 10 has the base plate 12 of about 50 μm and the water-repellent plate 14 of about 10 μm in thickness. Further, the nozzle 16 is set to about 25 to 50 μm in length and about 15 to 25 μm in diameter, and the counterbore portion 28 is set to about 3 to 5 μm in depth and about 50 to 100 μm in diameter.

Next, a method of manufacturing the nozzle plate 10 according to the first embodiment will be described.

Figure 3A:
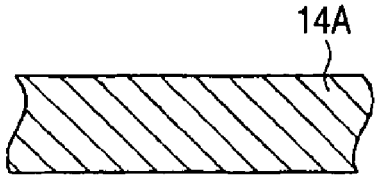
FIGS. 3A to 3D are explanatory diagrams of a method of manufacturing the nozzle plate shown in FIG. 1.

First, as shown in FIG. 3A, a plate-like plate material 14A (10 μm in thickness) for forming the water-repellent plate 14 that forms the nozzle plate 10 is provided. As the plate-like plate material 14A, a fluorocarbon resin such as polytetrafluoroethylene is used in the embodiment.

Figure 3B:
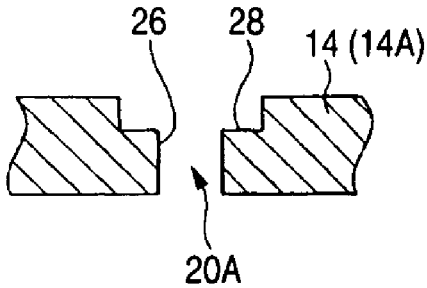

Then, as shown in FIG. 3B, laser machining is performed on the plate-like plate material 14A by applying a laser beam from a laser oscillator (not shown) via a mask (not shown) to form a through hole 20A (the straight form portion 26) having the same diameter as the nozzle diameter, and further, the counterbore portion 28 is coaxially formed with the through hole 20A on the surface of the plate-like plate material 14A. This hole machining forms the water-repellent plate 14, and, after the machining, the water-repellent plate 14 is ultrasonically cleansed with pure water, or cleansed with water shower to remove cuttings at the time of machining.

Figure 3C:
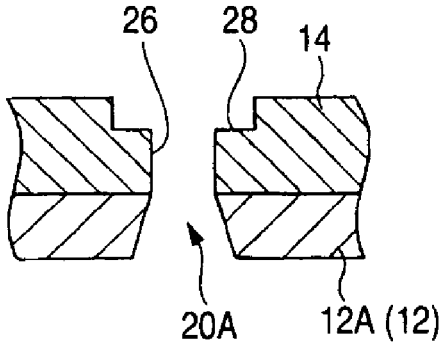

Then, as shown in FIG. 3C, a lamination layer (a film) of 50 μm in thickness is formed with a ceramic powder for forming a base layer that forms the base plate 12 by the aerosol deposition method (high-speed deposition method) at the opposite side to the ink ejection side (the side on which the counterbore portion 28 is formed) of the water-repellent plate 14.

Figure 4:
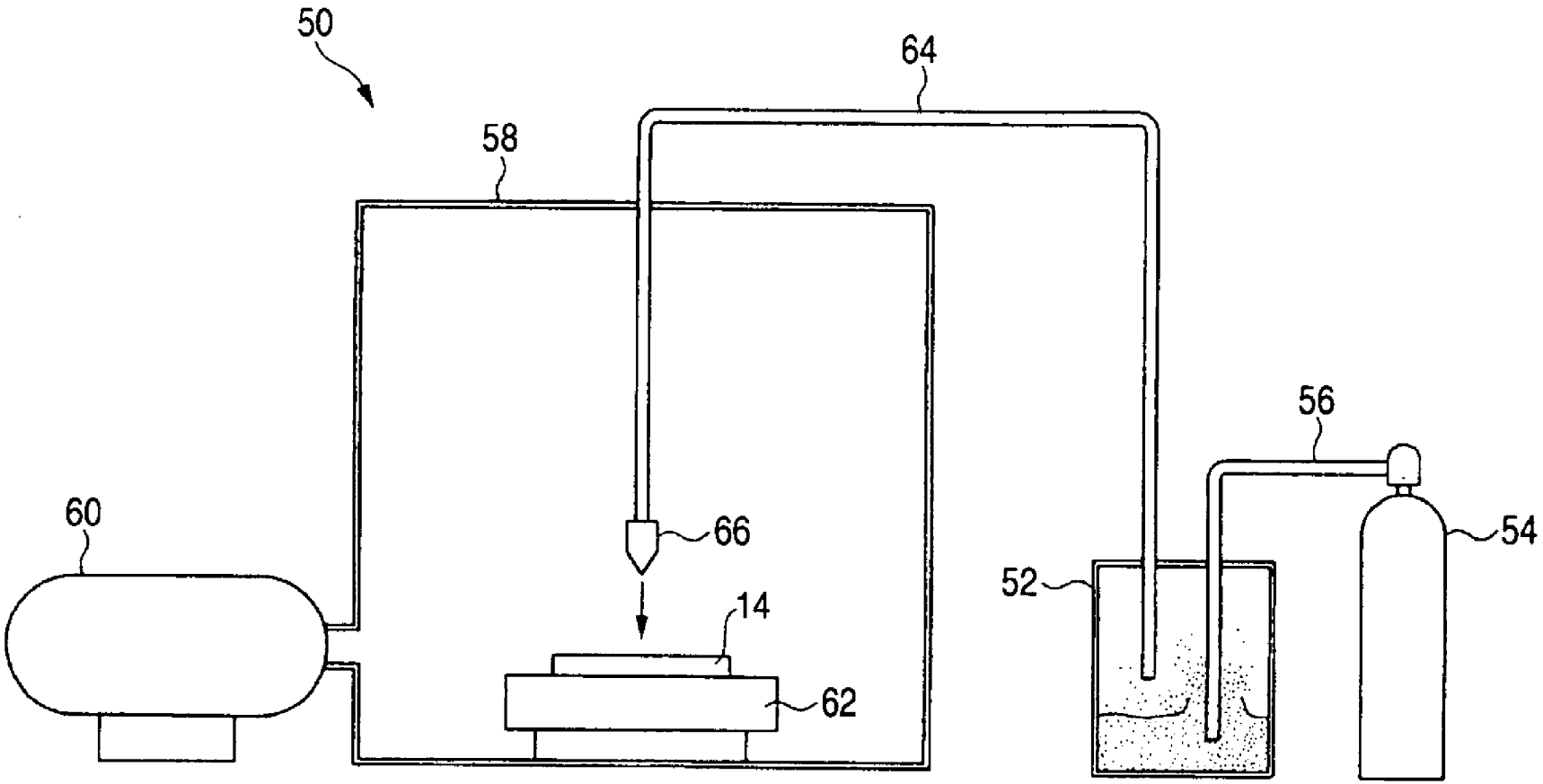
FIG. 4 schematically shows the structure of a deposition system for forming a film on a deposited member by the aerosol deposition method.

FIG. 4 shows a deposition system 50 for forming a film of the base layer on the water-repellent plate 14 by the above described aerosol deposition method.

As shown in FIG. 4, the deposition system 50 includes an aerosol chamber 52 in which an aerosol is generated, and a compressed-air cylinder 54 for injecting compressed air through an intake pipe 56 into the aerosol chamber 52. In the aerosol chamber 52, a ceramic powder as a material for forming the base plate 12 is accommodated.

Further, the deposition system 50 includes a deposition chamber 58 for forming a film by spraying the aerosol produced in the aerosol chamber 52 on the deposited member (water-repellent plate 14). A vacuum pump 60 for vacuum suction in the deposition chamber 58 is connected to the deposition chamber 58, and a stage 62 on which the deposited member is set is provided within the deposition chamber 58.

A feed pipe 64 for feeding the aerosol from the aerosol chamber 52 to the deposition chamber 58 is provided between the deposition chamber 58 and the aerosol chamber 52. At the tip end of the feed pipe 64 drawn into the deposition chamber 58, a nozzle 66 for spraying the aerosol toward the deposited member set on the stage 62 is provided.

To form a film with a ceramic powder for forming the base layer on the water-repellent plate 14 by the aerosol deposition method using thus formed deposition system 50, the water-repellent plate 14 is set on the stage 62 within the deposition chamber 58 and vacuum suction is performed in the deposition chamber 58 by activating the vacuum pump 60 to predetermined pressure.

Subsequently, the compressed air is supplied from the compressed-air cylinder 54 to the aerosol chamber 52, sprayed to raise a cloud of ceramic powder within the aerosol chamber 52, and generate an aerosol. Thereby, the ultrafine particles of ceramic powder contained in the aerosol are sprayed at a high speed from the nozzle 66 through the feed pipe 64 toward the water-repellent plate 14. Then, the ultrafine particles of the ceramic powder colliding against the water-repellent plate 14 at the high speed by the spraying are crushed into smaller ones by the collision energy. These minute fragment particles adhere to the collision surface of the water-repellent plate 14 and adhesively bonded to one another so as to form a dense ceramic structure.

Figure 3D:
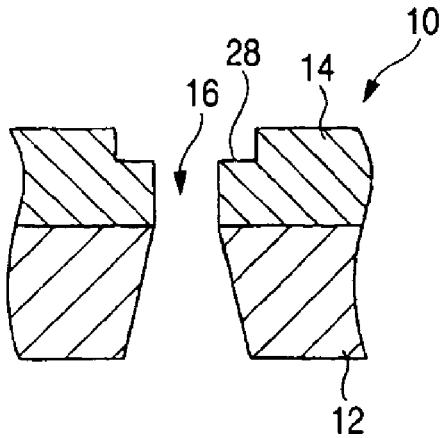

Thus, by the aerosol deposition method using the deposition system 50, as shown in FIG. 3D, a base layer 12A (base plate 12) of the ceramic structure is laminated on the water-repellent plate 14. Further, the ceramic powder is deposited conformingly to the hole form in the through hole 20A portion to form the nozzle 16, and this nozzle 16 includes a continuous surface with no step at the joint portion of the straight form portion 24 (not shown) at the base plate 12 side and the straight form portion 26 at the water-repellent plate 14 side. By the process above, the nozzle plate 10 is completed.

Next, the operation of the above described nozzle plate 10 will be described.

Figure 5A:
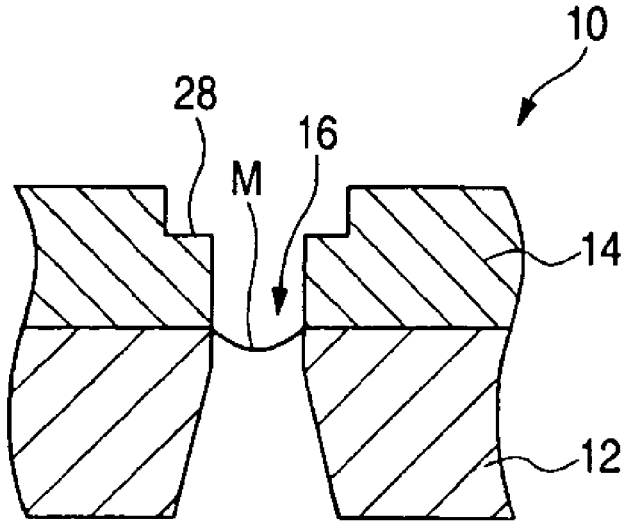
FIG. 5A is an enlarged longitudinal sectional view showing a state of a meniscus before ink ejection in the nozzle according to the first embodiment.
Figure 5B:
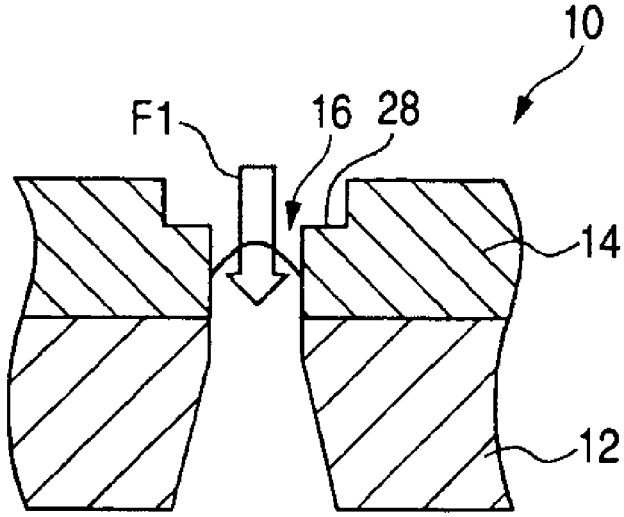
FIG. 5B is an enlarged longitudinal sectional view showing a state of the meniscus after ink ejection in the nozzle in FIG. 5A.
Figure 10A:
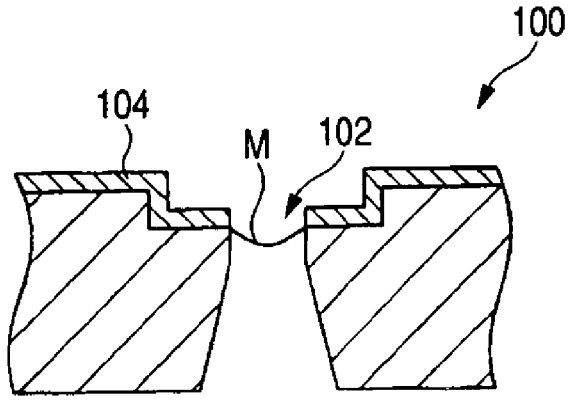
FIG. 10A RELATED ART
FIG. 10A is an enlarged longitudinal sectional view showing a state of a meniscus before ink ejection in a conventional nozzle and FIG. 10B is an enlarged longitudinal sectional view showing a state of the meniscus after ink ejection in the nozzle in FIG. 10A.
Figure 10B:
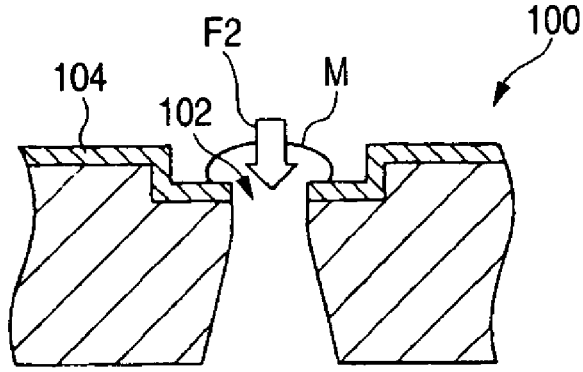
FIG. 10B RELATED ART
Figure 11:
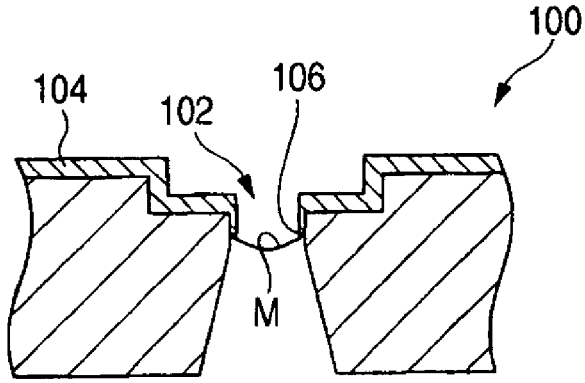
FIG. 11 RELATED ART
FIG. 11 is an enlarged longitudinal sectional view showing a state of the meniscus before ink ejection in the conventional nozzle, in which a water-repellent film enters the nozzle.

In the nozzle plate 10 of the embodiment, the water-repellent plate 14 is provided in place of the conventional water-repellent film (water repellent treatment). Since the water-repellent plate 14 can be formed to have a thickness sufficiently thicker than that formed by the filming treatment, as shown in FIG. 5A, the meniscus M before ink ejection is positioned deeper than the conventional surface of the nozzle 16. Accordingly, as shown in FIG. 5B, at the time of ink refill after ink ejection, the protrusion to the nozzle surface side of the meniscus due to overshoot becomes hard to occur and the curvature of the meniscus surface is maintained and the surface tension of the meniscus M becomes larger. In FIG. 5B, the recovery force of the meniscus produced by the surface tension of the meniscus is shown by the size of the arrow F1 in comparison with the arrow F2 in FIG. 10B.

Thereby, the meniscus can be recovered quickly, the ink droplets can be ejected at a high speed, and high-speed driving can be performed in the inkjet recording head 102 having the nozzle plate 10.

Further, since the nozzle 16 formed in the nozzle plate 10 has a structure not forming steps by entering the water-repellent film into the nozzle for prevention of the overflow of the meniscus like the convention alone, but including the straight form portion 24 formed at the base plate 12 side and the straight form portion 26 formed at the water-repellent plate 14 side, their opening diameters are constant toward the ink ejection direction, and the joint portion of the straight form portions 24 and 26 is a continuous surface with no step, the nozzle diameter never becomes smaller at the water-repellent part. Further, the nozzle can be formed without controlling the entrance amount of the water-repellent part into the nozzle, i.e., the entrance amount of ink, and thereby, variations in ink ejection directionality can be improved. Therefore, the ink ejection directionality can be stabilized and image quality deterioration can be prevented.

Further, in the nozzle plate 10 of the embodiment, since the nozzle 16 having the long straight form portions can be formed by the straight form portion 24 provided in the through hole at the base plate 12 side and the straight form portion 26 provided in the through hole at the water-repellent plate 14 side, variations in ink ejection directionality can be made even smaller, and the ink ejection directionality can be further stabilized.

Further, in the nozzle plate 10 of the embodiment, since the counterbore portion 28 having the larger diameter than the nozzle diameter is provided at the part corresponding to the nozzle 16 in the surface of the water-repellent plate 14, production of a scratch or chip is reduced in the water-repellent part of the nozzle surface by the counterbore portion 28 at the time of maintenance of the nozzle 16, paper jam, or the like. Thereby, the ink ejection directionality can be prevented from becoming deteriorated and predetermined image quality can be maintained.

Further, in the method of manufacturing the nozzle plate 10 of the embodiment, the through hole 20A that forms the nozzle is formed in advance in the water-repellent plate 14 and then the base layer 12A is formed by the aerosol deposition method, and thus, the through hole is formed conformingly to the hole form of the through hole 20A of the water-repellent plate 14 in the base layer 12A. Thereby, post-machining of the nozzle is no longer necessary and the simplification of the manufacturing process and the reduction of manufacturing cost can be achieved.

Second Embodiment

Next, a method for manufacturing a nozzle plate according to a second embodiment will be described.

Figure 6A:
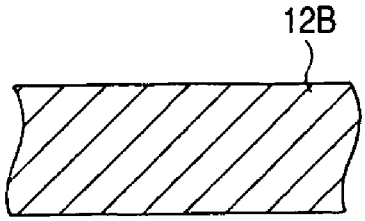
FIGS. 6A to 6D are explanatory diagrams of a method of manufacturing a nozzle plate according to a second embodiment of the invention.
Figure 6A:
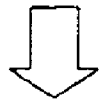
Figure 6B:
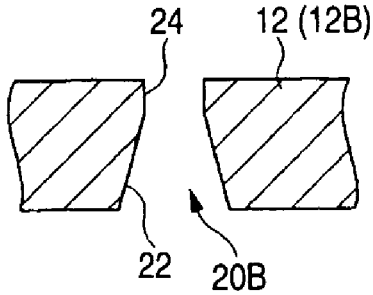
Figure 6B:
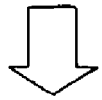
Figure 6C:
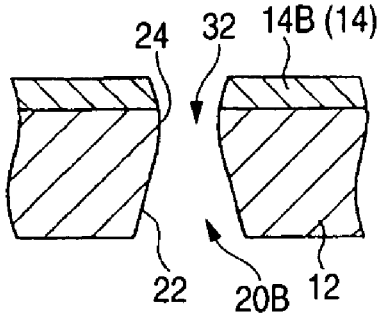
Figure 6C:
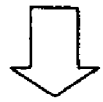
Figure 6D:
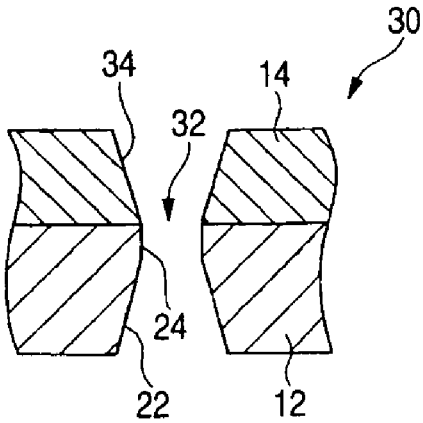

In FIG. 6D, a nozzle plate 30 of the embodiment is shown, and, in the method for manufacturing the nozzle plate 30 of the embodiment, first, as shown in FIG. 6A, a plate-like plate material 12B (50 μm in thickness) for forming a base plate 12 that forms the nozzle plate 30 is provided. This plate-like plate material 12B is made of a polymeric resin material, and, in the embodiment, formed by a polyimide resin. Using the polyimide resin, there are advantages that the laser machining is easier than that for the conventional SUS, and crosstalk is suppressed by the damper effect when the ejection energy is provided to the ink.

Then, as shown in FIG. 6B, laser machining is performed on the plate-like plate material 12B by applying a laser beam via a mask (not shown) to form a straight form portion 24 having the same diameter as the nozzle diameter and a through hole 20B including a tapered portion 22. This hole machining forms the base plate 12, and, after the machining, the base plate 12 is cleansed to remove cuttings at the time of machining. Further, the straight form portion 24 formed by laser machining forms a nozzle 32 of the nozzle plate 30 of the embodiment.

Then, as shown in FIG. 6C, a material having water repellency for forming a water-repellent layer that forms a water-repellent plate 14 is laminated to have a thickness of 10 μm on the surface (front surface) at the ink ejection side of the base plate 12 by the aerosol deposition method that has been described in the first embodiment.

Thereby, as shown in FIG. 6D, a water-repellent layer 14B (water-repellent plate 14) is laminated on the base plate 12, and a material having water repellency is deposited conformingly to the hole form in the through hole 20B part and a water-repellent portion 34 having a tapered form with an opening diameter becoming larger toward the ink ejection direction is formed at the ink ejection side of the nozzle 32. Further, the joint portion of the water-repellent portion 34 and the nozzle 32 (straight form portion 24) is an angular portion formed by a continuous surface with no step. Thus, the nozzle plate 30 of the embodiment is completed.

In this nozzle plate 30, by forming the water-repellent plate 14 by the aerosol deposition method, the water-repellent plate 14 having a uniform thickness sufficiently thicker than the conventional water-repellent film and good form can be formed. Because of this plate-like water-repellent layer, as well as in the nozzle plate 10 in the first embodiment, the meniscus before ink ejection is positioned deeper than the conventional nozzle surface (nozzle plate surface), and, at the time of ink refill after ink ejection, the protrusion to the nozzle surface side of the meniscus due to overshoot becomes hard to occur. Accordingly, the curvature of the meniscus surface is made smaller and the surface tension of the meniscus becomes larger, and thereby, the meniscus can be recovered quickly, the ink droplets can be ejected at a high speed.

Further, since the water-repellent film does not enter the nozzle 32 formed in the nozzle plate 30 like the conventional one, and the joint portion of the nozzle 32 and the water-repellent portion 34 is a continuous surface with no step (angular portion), the nozzle diameter never become smaller due to the water-repellent portion, and the nozzle can be formed without controlling the entrance amount of ink into the nozzle. Thereby, the ink ejection directionality can be stabilized and image quality deterioration can be prevented.

Further, in the embodiment, by forming the water-repellent plate 14 by the aerosol deposition method, the water repellent portion having the plate-like (thick film) and good form with uniform thickness, which is impossible to be formed by the conventional spin coating method or the like, can be obtained. Thereby, the nozzle plate 30 by which the ink droplets can be ejected at a high speed and the image quality deterioration can be prevented by stabilizing the ink ejection directionality can be formed with high quality. Further, the through hole 20B that forms the nozzle is formed in advance in the base plate 12 and then the water-repellent layer 14B is formed by the aerosol deposition method, and thus, the through hole is formed conformingly to the hole form of the through hole 20B of the base plate 12 in the water-repellent layer 14B. Thereby, post-machining is no longer necessary at the nozzle portion and the simplification of the manufacturing process and the reduction of manufacturing cost can be achieved.

The invention has been described by the above first and second embodiments in detail, however, the invention is not limited to those embodiments and other various embodiments can be implemented within the scope of the invention.

For example, in the method of manufacturing the nozzle plate described in the first and second embodiments, the case where the base layer 12A and the water-repellent layer 14B are laminated by the aerosol deposition method has been described, however, the plating method can be used instead.

Further, in the same method of manufacturing the nozzle plate, thorough holes that form the nozzles have been formed in advance in the base plate 12 and the water-repellent plate 14, however, the nozzles may be formed by the laser machining or the like after the lamination of the above described base layer 12A and the water-repellent layer 14B without forming the through holes.

Further, the thicknesses of the water-repellent plate 14 and the water-repellent layer 14B are not limited to 10 μm, but can be appropriately set in a range from 4 to 30 μm. In the case where the nozzle diameter is 15 to 25 μm as described above, they may be set to ¼ to 1.2 times the nozzle diameter.

As described above, some embodiments of the invention are outlined below.

According to an embodiment of the invention, a nozzle plate in which plural nozzles that eject ink droplets onto a recording medium are formed includes: a base plate that forms a nozzle plate main body; a water-repellent plate laminated on a surface of the base plate and having water repellency; and the nozzles formed by at least one of through holes formed in the base plate and the water-repellent plate and having continuous surfaces of joint portions of the base plate and the water-repellent plate in those through holes, wherein a thickness of the water-repellent plate is approximately 4 to 30 μm.

In the nozzle plate according to the embodiment, since the water-repellent plate having a thickness of 4 to 30 μm sufficiently thicker than the conventional water-repellent film (water-repellent treatment) to the base plate that forms the nozzle plate main body, the meniscus before ink ejection is positioned deeper from the nozzle surface than the conventional one. Accordingly, at the time of ink refill after ink ejection, the protrusion to the nozzle surface side of the meniscus due to overshoot becomes hard to occur, the curvature of the meniscus surface is maintained, and the surface tension of the meniscus becomes larger. Thereby, the meniscus can be recovered quickly, the ink droplets can be ejected at a high speed, and the high-speed driving can be performed in the inkjet recording head having the nozzle plate.

Further, since the nozzle has a structure not forming steps by entering the water-repellent film into the nozzle for prevention of the overflow of the meniscus like the conventional one, but including at least one of the through holes formed in the base plate and the water-repellent plate and the joint portions of the base plate and the water-repellent plate in those through holes are continuous surfaces, the nozzle diameters never become smaller at the water-repellent parts. Further, the nozzles can be formed without controlling the entrance amounts of the water-repellent parts into the nozzles, i.e., entrance amounts of ink, and thereby, variations in ink ejection directionality can be improved. Therefore, the ink ejection directionality can be stabilized and image quality deterioration can be prevented.

In a nozzle plate according to another embodiment of the invention, the nozzle may include first straight form portions provided in the through holes at the base plate side and having opening diameters constant toward an ink ejection direction and second straight form portions provided in the through holes at the water-repellent plate side and having opening diameters constant toward the ink ejection direction.

In the nozzle plate according to the embodiment, since the nozzles having long straight form portions can be formed by the first straight form portions provided in the through holes at the base plate side and the second straight form portions provided in the through holes at the water-repellent plate side, variations in ink ejection directionality can be made even smaller, and the ink ejection directionality can be further stabilized.

In a nozzle plate according to another embodiment of the invention, counterbore portions having larger diameters than nozzle diameters may be provided in parts corresponding to the nozzles on a surface of the water-repellent plate.

In the nozzle plate according to the embodiment, by providing the counterbore portions having larger diameters than the nozzle diameters at the parts corresponding to the nozzles, production of scratches or chips are reduced in the water-repellent parts of the nozzle surfaces by the counterbore portions at the time of maintenance of the nozzles, paper jam, or the like. Thereby, the ink ejection directionality can be prevented from becoming deteriorated and predetermined image quality can be maintained.

According to an embodiment of the invention, a method of manufacturing a nozzle plate in which plural nozzles that eject ink droplets onto a recording medium are formed includes: forming through holes that form the nozzles in a water-repellent plate having water repellency; and laminating a base layer that forms a nozzle plate main body on the water-repellent plate in which the through holes are formed by an aerosol deposition method or a plating method.

In the method according to the embodiment, since the through holes that form the nozzles are formed in advance in the water-repellent plate and then the base layer is formed by the aerosol deposition method, and thereby, the through holes are formed conformingly to the hole forms of the through holes of the water-repellent plate in the base plate. Thereby, post-machining of the nozzles is no longer necessary and the simplification of the manufacturing process and the reduction of manufacturing cost can be achieved. Further, in the case of forming the base layer by the plating method, similarly, plural plates can be batch processed, and thereby, the reduction of manufacturing cost can be achieved.

According to another embodiment of the invention, a method of manufacturing a nozzle plate in which plural nozzles that eject ink droplets onto a recording medium are formed includes: laminating a base layer that forms a nozzle plate main body on a water-repellent plate having water repellency by an aerosol deposition method or a plating method; and forming through holes that form the nozzles in the laminated water-repellent plate and base plate.

In the method according to the embodiment, the base layer that forms the nozzle plate main body is laminated on the water-repellent plate by the aerosol deposition method or the plating method and then through holes that form the nozzles are formed in the water-repellent plate and base layer, and thus, this post-machining increases the degree of freedom of nozzle forms.

According to an embodiment of the invention, a method of manufacturing a nozzle plate in which plural nozzles that eject ink droplets onto a recording medium are formed includes: forming through holes that form the nozzles in a base plate that forms a nozzle plate main body; and laminating a water-repellent layer having water repellency on the base plate in which the through holes are formed by an aerosol deposition method or a plating method.

In the method according to the embodiment, by forming the water-repellent layer by the aerosol deposition method, the water repellent layer having the thick film and a good form with uniform thickness, which is impossible to be formed by the conventional spin coating method or the like, can be obtained. Thereby, the nozzle plate by which the ink droplets can be ejected at a high speed and the image quality deterioration can be prevented by stabilizing the ink ejection directionality can be formed with high quality.

Further, the through holes that form the nozzles are formed in advance in the base plate and then the water-repellent layer is formed by the aerosol deposition method, and thus, the through holes are formed conformingly to the hole form of the through holes of the base plate in the water-repellent layer. Thereby, post-machining of the nozzles is no longer necessary and the simplification of the manufacturing process and the reduction of manufacturing cost can be achieved. Further, in the case of forming the water-repellent layer by the plating method, similarly, plural plates can be batch processed, and thereby, the reduction of manufacturing cost can be achieved.

According to another embodiment of the invention, a method of manufacturing a nozzle plate in which plural nozzles that eject ink droplets onto a recording medium are formed includes: laminating a water-repellent layer having water repellency on a base plate that forms a nozzle plate main body by an aerosol deposition method or a plating method; and forming through holes that form the nozzles in the laminated base plate and water-repellent layer.

In the method according to the embodiment, by forming the water-repellent layer by the aerosol deposition method or the plating method, the water-repellent layer having the thick film and a good form with uniform thickness, which is impossible to be formed by the conventional spin coating method or the like, can be obtained. Thereby, the nozzle plate by which the ink droplets can be ejected at a high speed and the image quality deterioration can be prevented by stabilizing the ink ejection directionality can be formed with high quality.

Further, the water-repellent layer is laminated on the base plate and then through holes that form the nozzles are formed in the base plate and water-repellent layer, and thus, this post-machining increases the degree of freedom of nozzle forms.

A method according to another embodiment may further include forming counterbore portions having larger diameters than nozzle diameters in parts corresponding to the nozzles on a surface of the water-repellent plate.

In the method according the embodiments, the production of scratches or chips may be reduced in the water-repellent parts of the nozzle surfaces by the counterbore portions having larger diameters than the nozzle diameters at the parts corresponding to the nozzles, at the time of maintenance of the nozzles, paper jam, or the like. So, the ink ejection directionality can be prevented from becoming deteriorated and predetermined image quality can be maintained.

In a method according to another embodiment of the invention, the water-repellent plate or the water-repellent film may be formed to have a thickness of approximately 4 to 30 μm.

In the method according to the embodiment, when the thickness of the water-repellent plate or the water-repellent film is smaller than 4 μm, the effects of the high-speed ejection of ink droplets and stabilization of ejection directionality are decreased, however, when the thickness is equal to or more than 4 μm, sufficient effects of those can be obtained. Further, when the thickness of the water-repellent plate or the water-repellent film is larger than 30 μm, the water-repellent plate or the water-repellent film having a uniform thickness and a good form is difficult to be manufactured, however, when the thickness is equal to or less than 30 μm, the water-repellent plate or the water-repellent film with stable quality can be obtained.

In a method according to another embodiment of the invention, the through holes may be formed by laser machining.

In a method according to another embodiment of the invention, the counterbore portions may be formed by laser machining.

In the method according to the embodiments, by forming the through holes and the counterbore portions by laser machining, the number of machining steps can be made smaller and the machining time can be made shorter compared to the case of forming them by etching or the like.

Since the nozzle plate of the invention adopts the above described construction, the high-speed ejection of ink droplets can be performed and image quality deterioration can be prevented by stabilizing the ejection directionality. Further, since the method of manufacturing the nozzle plate of the invention adopts the above described method, the nozzle plate by which the high-speed ejection of ink droplets can be performed and image quality deterioration can be prevented by stabilizing the ejection directionality can be formed with high quality.

The foregoing description of the embodiments of the present invention has been provided for the purposes of illustration and description. It is not intended to be exhaustive or to limit the invention to the precise forms disclosed obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-276197 filed on Sep. 22, 2004 including specification, claims, drawings and abstract is incorporated herein by reference in its entirety.

What is claimed is:

1. A nozzle plate in which a plurality of nozzles that eject ink droplets onto a recording medium are formed, the nozzle plate comprising:

a base plate that forms a nozzle plate main body;

a water-repellent plate laminated on a surface of the base plate and having water repellency; and the nozzles being formed by at least one of through holes formed in the base plate and the water-repellent plate and having continuous surfaces of joint portions of the base plate and the water-repellent plate in those through holes;

the nozzles comprising first straight form portions provided in the through holes at the base plate side and having opening diameters constant toward an ink ejection direction and second straight form portions provided in the through holes at the water-repellent plate side and having opening diameters constant toward the ink ejection direction, the opening diameters of the first straight form portions being equal to the opening diameters of the second straight form portions;

wherein counterbore portions having larger diameters than nozzle diameters are provided in parts corresponding to the nozzles on a surface of the water-repellent plate, and a thickness of the water-repellent plate is approximately 4 to 30 μm.

* * * * *